United States Patent [19]

Hodate

[11] Patent Number: 5,028,749

[45] Date of Patent: Jul. 2, 1991

[54] PRESSURE SWITCH

[75] Inventor: Masato Hodate, Higashiyamato, Japan

[73] Assignee: Bridgestone Corporation, Tokyo, Japan

[21] Appl. No.: 451,059

[22] Filed: Dec. 15, 1989

[30] Foreign Application Priority Data

Dec. 17, 1988 [JP] Japan ..... 63-317611

[51] Int. Cl.[5] ..... H01H 35/24

[52] U.S. Cl. ..... 200/61.25; 200/83 B; 200/83 N

[58] Field of Search ..... 200/61.25, 83 A, 83 B, 200/83 N, 83 C, 61.22

[56] References Cited

U.S. PATENT DOCUMENTS 3,845,260 10/1974 Lohr ..... 200/83 N
3,885,223 5/1975 Green ..... 200/83 BX
3,944,769 3/1976 Wagner ..... 200/83 BX
4,180,795 12/1979 Matsuda et al. ..... 200/61.25 X
4,211,901 7/1980 Matsuda et al. ..... 200/61.25 X

*Primary Examiner*—J. R. Scott
*Attorney, Agent, or Firm*—Sughrue, Mion, Zinn Macpeak & Seas

[57] ABSTRACT

A pressure switch for use in a device for alarming the reduction of pneumatic pressure of vehicle tire is disclosed. The switch comprises a base board, a bellofram secured to the base board and having conductive coating of one electric contact applied to the inner surface and the outer surface thereof and having both bellows and diaphragm characteristic, a housing provided to enclose the bellofram and for defining a hermetic chamber, and a conductor provided at inner portion and outer portion of the bellofram near the center of the diaphragm portion thereof and for forming another electric contact. A back pressure is applied to the inner portion or outer portion of the bellofram against the pneumatic pressure of a vehicle tire.

14 Claims, 4 Drawing Sheets

PRESSURE SWITCH

BACKGROUND OF THE INVENTION

The present invention relates to a pressure switch, particularly, to a pressure switch for use in a sensor of a device for alarming the reduction of pneumatic pressure of vehicle tire.

Such a pressure switch used in a sensor provided in the device for alarming the reduction of pneumatic pressure of vehicle tire, is constructed as shown in FIG. 5. That is, a diaphragm 1 and a contact rod 3 having one contact 2 provided on the tip thereof are secured to a holder or supporting member 4 so as to form or define a back pressure chamber 5, and then gas is sealed in the back pressure chamber 5 from a back pressure sealed inlet 6 until normal pressure (usually the same pressure as the pneumatic pressure of a tire, for example, 2.5 kg/cm$^2$) is obtained, and then the sealed inlet 6 is sealed and welded with a sealing steel ball 7. The contact rod 3 and the holder 4 are secured in a housing 8 which is also co-used as a hexagon nut, and then epoxy resin 19 is filled in the housing 8. The housing 8 is, then, threaded on a housing 11 by an O-ring 12 in which an oscillating coil or a resonance coil 9 and a capacitor 10 are accommodated. The resonance coil 9 is wound on a core 13 of magnetic substance.

In this case, a pin hole is liable to result in a welded portion 14 of the diaphragm 1 and the supporting member 4, and thus the gas pressure in the back pressure chamber 5 becomes equal to the air pressure in the wheel tire, so that the pressure switch is maintained in an opened condition or closed condition.

When a pin hole is caused at the welded portion of the sealing steel ball 7 and the sealed inlet 6 of the supporting member 4, the gas is liable to leak through the epoxy resin 19 or a side wall 15 of the housing 8. The side wall 15 is provided with two O-rings 12 at separate portions thereof, but the sealing with these O-rings is not sufficient, since a slight gas leak results in a large pressure loss due to small capacity of the back pressure chamber 5.

In order to improve the detecting capability of pressure difference by the diaphragm 1, moreover, it can not avoid to make the diameter of the diaphragm 1 large, so that if the diameter of the diaphragm 1 is 15 mm~20 mm, the diameter of threaded portion provided on the surface of the side wall 15 is 30 mm~35 mm or more.

Since in the latter case, the pressure of the back pressure chamber 5 is decreased, the precision of detecting the reduction of pneumatic pressure of a vehicle tire after fabrication gradually decreased. That is, when the pneumatic pressure of the vehicle tire is at a normal pressure, 2.5 kg/cm$^2$, gas pressure of the back pressure chamber 5 also becomes substantially 2.5 kg/cm$^2$, so that the contact 2 is always contacted to the diaphragm 1. If the pneumatic pressure of tire is decreased by 0.5 kg/cm$^2$, the contact 2 is released, resulting in a switched off condition so that the alarming device generates an alarm together with other circuits. In this case, when the operating pressure of the diaphragm 1 is 2.0 kg/cm$^2$, and the pressure of the back pressure chamber 5 is decreased by 0.5 kg/cm$^2$, then the switch does not switch to the off state, and the alarm does not occur as long as the pneumatic pressure of the vehicle tire is not decreased to 1.5 kg/cm$^2$.

In order to eliminate such a disadvantage, that is, in order to prevent secular change of detection capability, or to perform small size, light weight and inexpensive price, a pressure switch shown in FIG. 6 has been provided. That is, a cup-shaped diaphragm 21 is placed on the bottom of a housing 20 having a step portion and these components are welded to form a hermetic chamber. A contact 22 is provided to the center portion of the diaphragm 21. A ceramic contact rod supporting plate 25 is provided with a female screw bush 23 at the center thereof. A screw contact rod 24 is adjustably inserted in the bush 23. The supporting plate 25 is inserted in the housing 20 and placed and fixed on and to the step portion thereof, to define a hermetic chamber 26 corresponding to the back pressure chamber and then epoxy resin 27 is filled onto the supporting plate 25, thereby forming a pressure switch. Since in the pressure switch shown in FIG. 5 the back pressure switch has a gas pressure which is the same as the pneumatic pressure of the tire which is higher than atmospheric pressure thereby causing a problem, the back pressure chamber, that is, the hermetic chamber 26 of the pressure switch shown in FIG. 6 is the same pressure as the atmospheric pressure. In the pressure switch shown in FIG. 6, in order to prevent inflow and outflow of air due to expansion (pressure increase) and reduction (pressure decrease) of air in the ccrresponding back pressure chamber with variations in atmospheric temperature, resin such as epoxy is injected and fixed on and to the supporting plate 25 for the contact rod 23. In this case, when the atmospheric temperature is higher than that of the pressure switch during manufacture the expanded air in the hermetic chamber 26 leaks and then when the atmospheric temperature is lower than the above temperature or equal to the normal temperature, the air in the hermetic chamber 26 becomes lower than the atmospheric pressure and thus the detecting precision becomes decreased.

As described above, in the conventional pressure switch, when gas is sealed in the hermetic chamber or back pressure chamber to obtain a suitable back pressure, and then to cause the switch pressure to be substantially proportional to the absolute temperature, gas is leaked outwardly through the cover member or substance of epoxy resin, so that the switch pressure-temperature characteristic can not be maintained for long period.

When the pressure switch is used in the device for alarming the reduction of pneumatic pressure of a vehicle tire, it is desirable to use a small pressure switch. Even if, in the conventional diaphragm system, the size of the diaphragm must be made small in order to obtain a small pressure switch, however, the displacement of the diaphragm becomes very small, so that the precision of pressure detection is decreased and thus the pressure switch can not be made small.

The diaphragm can not be fabricated with continuous thickness, so that any switch pressure characteristic can not be obtained.

SUMMARY OF THE INVENTION

It is an object of the present invention to eliminate the above described disadvantage of the conventional pressure switch.

It is another object of the present invention to provide a pressure switch with small size and high precision and independent of temperature variation.

According to the present invention, there is provided a pressure switch comprises a base board capable of hermetic sealing, a bellofram secured to the base board and having conductive coating of one electric contact applied to the inner surface or the outer surface thereof and having both bellows and diaphragm characteristic, a housing provided to enclose the bellofram and for defining a hermetic chamber, and a conductor provided at inner portion or outer portion of the bellofram near the center of the diaphragm portion thereof and for forming another electric contact, whereby a back pressure is applied to the inner portion or outer portion of the bellofram against the pneumatic pressure of vehicle tire.

The present invention is based on the fact that a bellofram having both bellows and diaphragm characteristics is developed to obtain large displacement thereof and a hermetic sealing technique is advanced so that gas may be completely sealed by using a mounting plate for a transistor.

The bellofram is provided with a projection protruding inner or outer thereof at the center of the diaphragm portion, thereby forming a bellofram contact, that is, one of several electric contacts.

The bellofram is provided with additional mass at the side of the diaphragm portion opposite to the contact forming projection, so as to be sensitive to centrifugal acceleration.

In order to manufacture the bellofram, the following electrodeposition process is used so that the pressure switch has a small size, is light weight and has high precision.

At first, provision is made of a metal with a comparatively low melting point, for example, aluminum, and a female mold or male mold for a bellofram having desired dimension and shape is prepared by subjecting the metal to a preferable molding process. When an electric contact is formed at outer side of the bellofram, the female mold having an outer shape of the bellofram is used. The female mold is plated with a gold layer having a thickness of about $1\sim3$ $\mu$m and then the gold plated layer is plated with a metal layer having a thickness of $30\sim100$ $\mu$m and having comparatively high melting point, hardness, high elastic modulus and corrosion resistance, such as nickel. The thus obtained female mold with the plated layers is subjected to the melting process or chemical treatment, thereby obtaining a desired bellofram. When the electric contact is formed at the inner side of the bellofram, the male mold is used and this male mold is subjected to the same plating process as described above, thereby obtaining a desired bellofram. When this electrodepositing process is used, it is possible to obtain a bellofram which is small in size, has a light weight, and is highly precise and reliable so that the pressure switch may be of small size and thus the pressure sensor may easily be secured to the rim portion of the wheel tire in the same manner as the attachment of the tire valve. Alternatively, a desired bellofram may be obtained by dissolving only a male or female mold with the use of chemicals which dissolve only aluminum. If the order of plating process is charged or exchanged, also, for respective molds, electric contacts may be formed at the inner or outer side of the bellofram.

The contact surface of the conductor forming another electric contact is a flattened surface.

The back pressure of the gas sealed in the inner portion or the outer portion of the bellofram is adjusted to change the switch pressure in proportion to substantially absolute temperature.

Since as described above, the bellofram is manufactured by the above electrodeposition process (plating process) with high precision and higher reliability, sum thickness of the bellofram and the conductive layer may be arbitrarily adjusted so as to obtain a desired switch pressure characteristics and thus a pressure switch having the same size from low pressure switch for small vehicle tire to high pressure with for bus and track tire.

The utilization of a bellofram according to the present invention allows the pressure switch to be small in size and membrane displacement of the diaphragm large, so that the precision of the switch pressure may be increased sufficiently.

Hermetic seal may be performed by the transistor mounting base or plate so that gas may be sealed easily and thus the temperature characteristic of the switch does not change with time.

The bellofram is provided with additional mass at the side of the diaphragm portion opposite to the contact forming projections, thereby becoming sensitive centrifugal acceleration, so that when the pressure switch according to the present invention is used in the device for alarming the reduction of pneumatic pressure of a vehicle tire, the detection sensitivity of the tire may be increased at a high running speed.

DETAILED DESCRIPTION OF THE PREFERRED EMBODIMENTS

Now to the drawings, there is shown a pressure switch according to the present invention.

Figure 1:
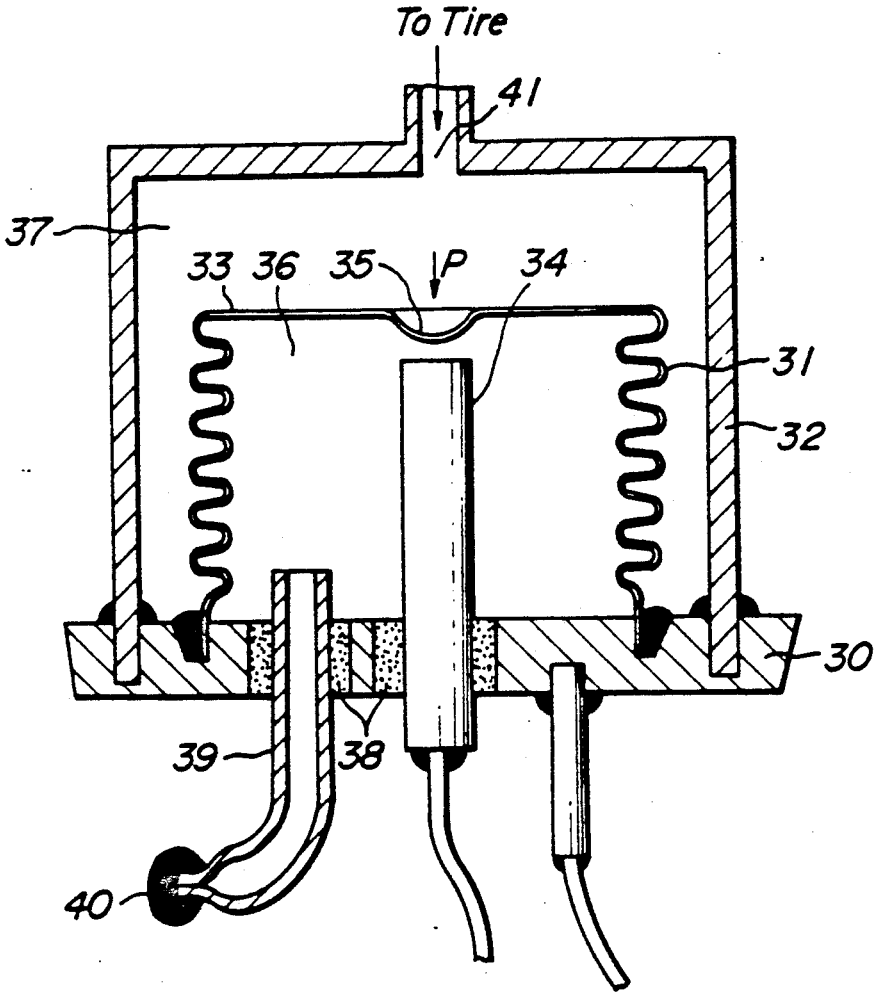
FIG. 1 is a sectional view showing the construction of a pressure switch according to the present invention.

As shown in FIG. 1, the pressure switch according to the present invention comprises a back pressure chamber 36 by securing a bellofram 31 to a metal base or base board 30 for example with welding or the like. The metal base 30 is constructed by, for example, a transistor mounting base plate so as to perform easily an hermetic seal. A diaphragm portion 33 of the bellofram 30 is provided with a projection 35 protruding inward at the center portion thereof. The projection 35 serves as one electric contact. The bellofram 30 is provided with a housing 32 at the out side thereof. The housing 32 is secured to the metal base 30 by, for example, welding, thereby defining a hermetic chamber 37 therebetween. A conductive contact rod 34 is inserted in the bellofram 31 through the metal base 30 at its center portion in such a manner that the flat tip of the contact rod 34 is placed near the projection 35. A glass 38 is provided between the contact rod 34 and the metal base 30 so as to provide a hermetic seal. A back pressure feeding pipe 39 is inserted in the bellofram 31 through the metal base 30 by providing glass therebetween for hermetic seal. The free end of the back pressure feeding pipe 39 is caulked and hermetic-sealed with high temperature or hard solder 40 after sealing gas with a desired pressure in the back pressure chamber 36. The housing 32 is provided at upper wall with a communication hole 41 for communicating the hermetic chamber 37 to the inner space of the vehicle tire.

Figure 2:
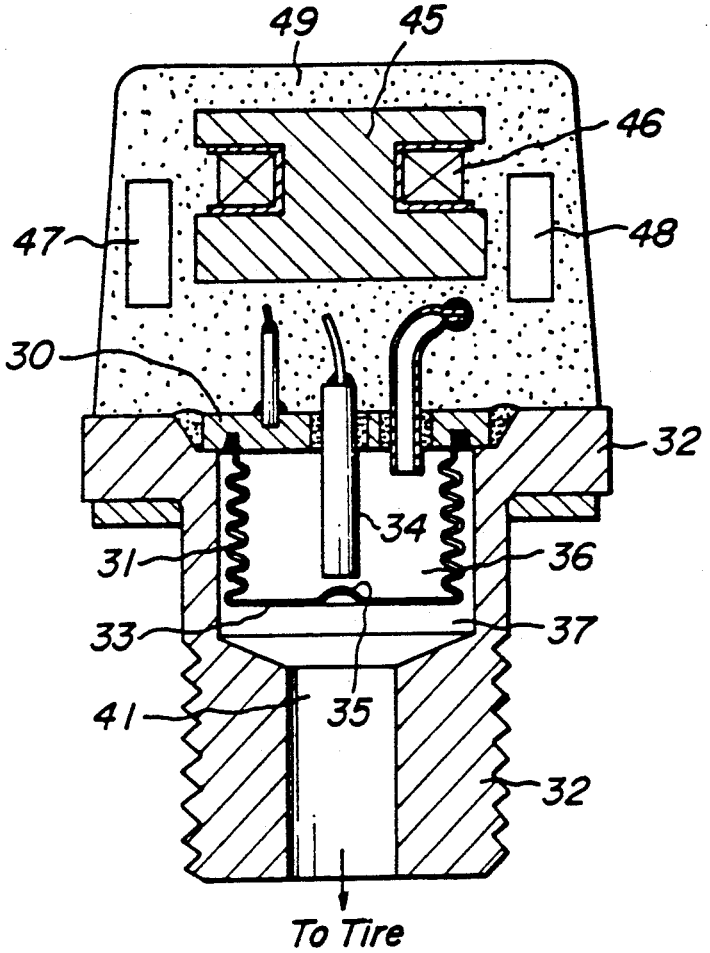
FIG. 2 is a sectional view showing the condition that the pressure switch according to the present invention is mounted to the resonator of the device for alarming the reduction of pneumatic pressure of a vehicle tire and is integrally constructed together with the other components of the resonator.

When the thus constructed pressure switch according to the present invention is used in the device for alarming the reduction of pneumatic pressure of a vehicle tire, as shown in FIG. 2, the pressure switch is reversed to direct the bottom surface (FIG. 1) of the housing 32 upward on which a coil 46 wound on a core 45 of magnetic substance, a resistor 47 and a capacitor 48 are placed, and then these components are electrically connected to the pressure switch, and finally these components are fixed with resin 49 of epoxy or the like, thereby integrally assembling the pressure switch and the resonator.

Figure 3:
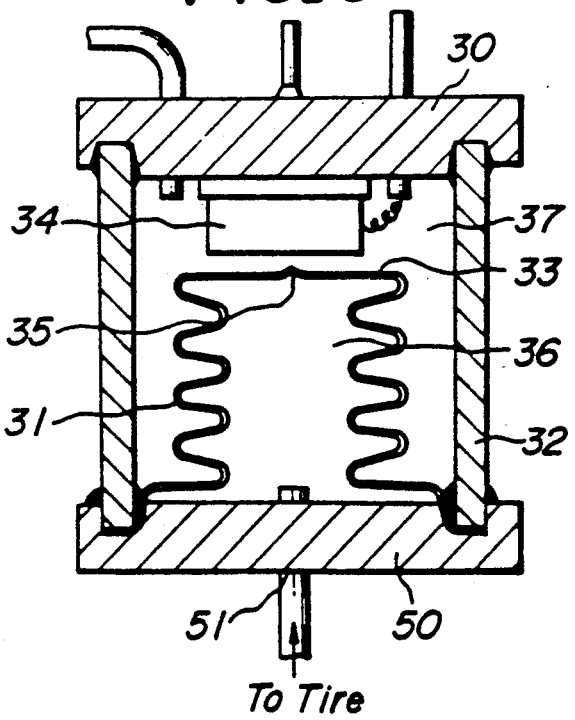
FIG. 3 is a sectional view showing the construction of another embodiment of the pressure switch according to the present invention.

FIG. 3 shows another embodiment of the pressure switch according to the present invention. In this embodiment, the bellofram 31 is secured to another supporting plate 50 instead of the metal base 30, and the projection 35 of the diaphragm portion 33 of the bellofram 31 is provided to the outer side thereof so as to contact with the flat tip of the contact rod 34. The bellofram 31 is enclosed by the metal base 30, housing 32 and the supporting plate 50, thereby defining the hermetic chamber 37. In this embodiment, the hermetic chamber 36 at the inner side of the bellofram 31 is communicated with the inner space of vehicle tire through a communication hole 51.

Figure 4:
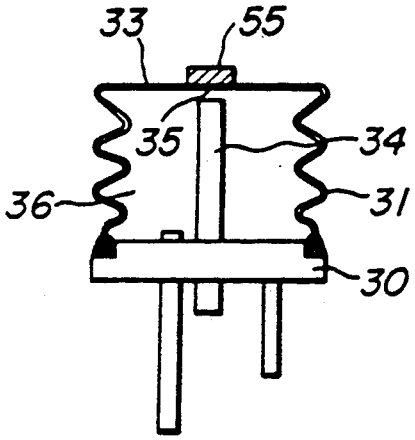
FIG. 4 is a sectional view showing an embodiment of the pressure switch according to the present invention.
Figure 5:
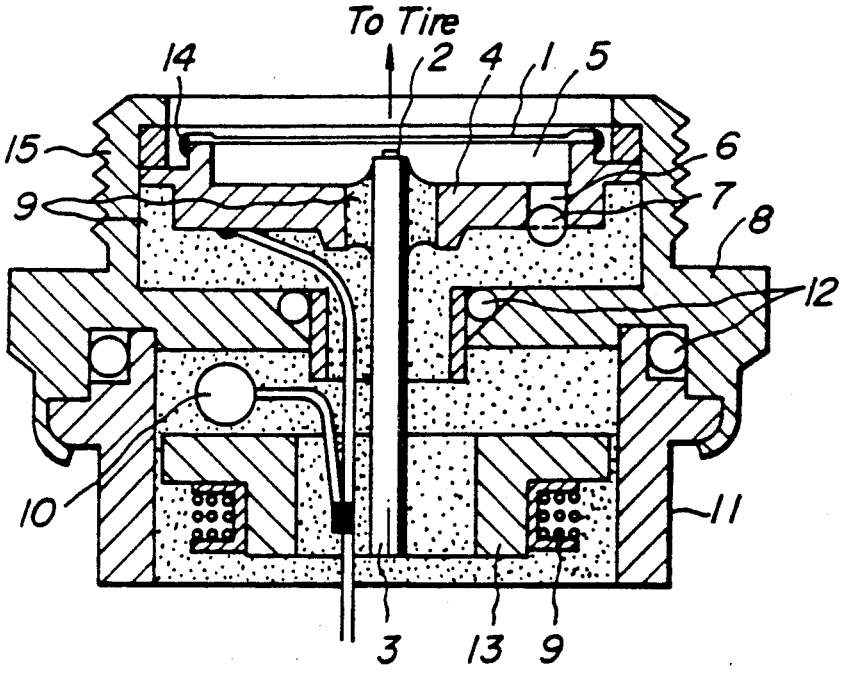
FIG. 5 PRIOR ART
FIG. 5 is a sectional view showing the construction of an embodiment of the conventional pressure switch.
Figure 6:
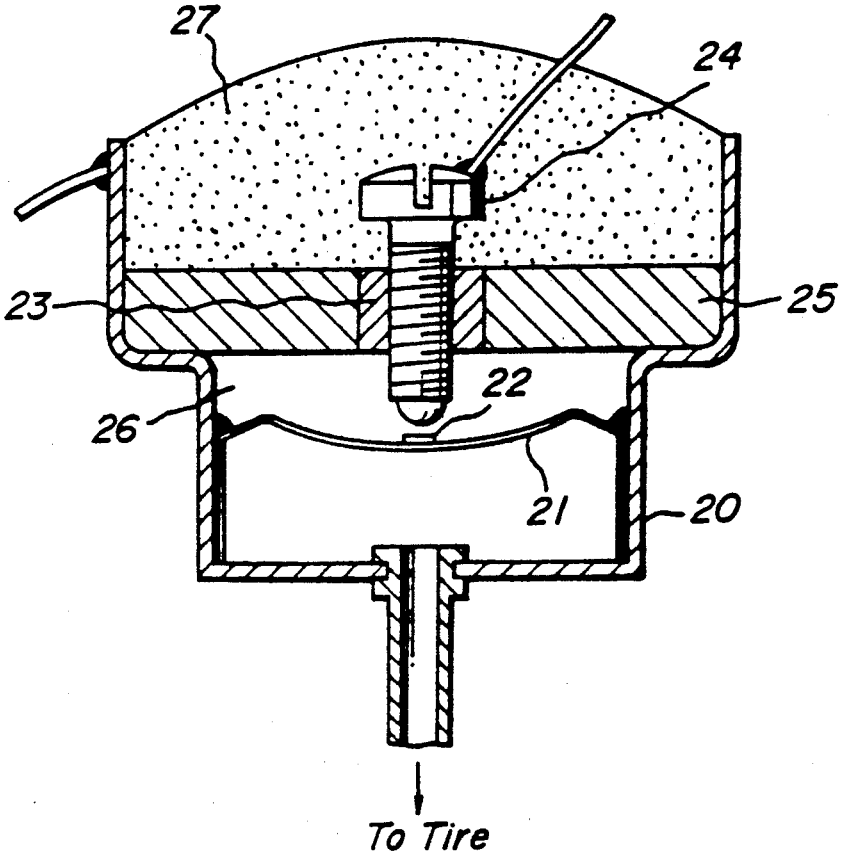
FIG. 6 PRIOR ART
FIG. 6 is a sectional view showing the construction of another embodiment of the conventional pressure switch.

A further embodiment of the pressure switch according to the present invention is shown in FIG. 4. In this embodiment, the bellofram 31 is secured to the metal base 30 in the same manner as in FIG. 1 and the contact projection 35 is provided in the inner side of the bellofram 31, but an additional mass 55 is provided at the side of the bellofram 31 opposite to the projection 35. The additional mass 55 performs the pressure adjustment by utilizing the centrifugal acceleration thereof.

Generally, the vehicle tire is intentionally used with the pressure lower than prescribed or indicated value in order to obtain a comfortable driving feeling. When the device for alarming the reduction of pneumatic pressure of vehicle tire is provided, such an intentional use can not be performed. According to this embodiment, the bellofram 31 is provided with additional mass 55 to obtain the pressure switch with centrifugal characteristics so that one type of the pressure switch may be applied to various vehicle tires ranging from low pressure to high pressure tires corresponding to high running speed.

The actual numerical values of the thus constructed pressure switch according to the present invention shown in FIG. 1 are as follows.

The case that the pressure switch according to the present invention is used in the vehicle wheel for a passenger car, is shown. Normal air pressure of tire is 2.5 $kg/cm^2$, operating pressure is 2.5 $kg/cm^2-0.3$ $kg/cm^2=2.2$ $kg/cm^2$, maximum tolerance is $\pm 0.1$ $kg/cm^2$. In this case, the height of the bellows of the bellofram 31 according to the present invention, that is, the height from the metal base 30 was 4 mm, its maximum outer diameter, that is, the diameter of the diaphragm 33 7.5 mm, the thickness of gold plated layer of bellofram was 1 $\mu m$ and the thickness of nickel plated layer was 60 $\mu m$.

As is found from a comparison of the above numerical values of the pressure switch according to the present invention with the conventional pressure switch, the pressure switch according to the present invention can be made small in size.

What is claimed is:

1. A pressure switch for a device which provides an alarm in response to a reduction of pneumatic pressure in a vehicle tire, said pressure switch comprising:

a base board;

a bellofram comprising a cylindrical metal bellows, and a metal diaphragm having a central portion, said bellows having one end which is integrally formed with the diaphragm, and having the other end electrically connected to said base board so as to enclose a space, said bellofram further having an inner surface which is coated with a conductive metal layer;

a rod conductor which is insulated from, and hermetically sealed to said base board, one end of said rod conductor being disposed adjacent the central portion of said diaphragm such that a switching contact is formed by said one end of said rod and the central portion of said metal diaphragm;

a closed-type housing having one end hermetically secured to said base board, and the other end in communication with an inner portion of the pneumatic vehicle tire, said bellofram being enclosed within said closed-type housing; and a pipe member for filling the space within said bellofram with a first gas, thereby providing a back pressure corresponding to a pressure to be detected in the pneumatic tire.

2. The pressure switch as claimed in claim 1, wherein the central portion of said diaphragm includes a projection which projects towards said one end of said rod conductor.

3. The pressure switch as claimed in claim 1, wherein the metal diaphragm of said bellofram is provided with an additional mass on a side of said diaphragm which is opposite to said projection, said additional mass allowing sensing of centrifugal acceleration.

4. The pressure switch as claimed in claim 1, wherein the conductive metal layer applied to the inner surface of said bellofram is a gold plated layer.

5. The pressure switch as claimed in claim 1, wherein a vertex surface of said conductor is flat.

6. The pressure switch as claimed in claim 1, wherein the pneumatic tire is filled with a second gas, said first and second gas being the same type of gas.

7. A pressure switch for a device which provides an alarm in response to a reduction of pneumatic pressure in a vehicle tire, said pressure switch comprising:

a base board;

a bellofram comprising a cylindrical metal bellows, and a metal diaphragm having a central portion, said bellows having one end which is integrally formed with the diaphragm, and having the other end electrically connected to said base board, said bellofram further having an inner surface which is coated with a conductive metal layer;

a rod conductor which is insulated from, and hermetically sealed to said base board, one end of said rod conductor being disposed adjacent the central portion of said diaphragm such that a switching contact is formed by said one end of said rod and the central portion of said metal diaphragm;

a closed-type housing having one end hermetically secured to said base board, and the other end in communication with an outer portion of the pneumatic vehicle tire, said bellofram being enclosed within said closed-type housing, a space enclosed by said close-type housing but not being enclosed by said bellows being termed a first space; and a pipe member for filling said first space with a first gas, thereby providing a back pressure corresponding to a pressure to be detected in the pneumatic tire.

8. The pressure switch as claimed in claim 7, wherein the central portion of said diaphragm includes a projection which projects towards said one end of said rod conductor.

9. The pressure switch as claimed in claim 7, wherein the metal diaphragm of said bellofram is provided with an additional mass on a side of said diaphragm which is opposite to said projection, said additional mass allowing sensing of centrifugal acceleration.

10. The pressure switch as claimed in claim 7, wherein the conductive metal layer applied to the inner surface of said bellofram is a gold plated layer.

11. The pressure switch as claimed in claim 7, wherein a vertex surface of said conductor is flat.

12. The pressure switch as claimed in claim 7, wherein the pneumatic tire is filled with a second gas, said first and second gas being the same type of gas.

13. The pressure switch according to claim 10, wherein said gold layer is plated to a thickness of between 1 and 3 $\mu$m.

14. The pressure switch according to claim 7, wherein said conductive metal layer has a thickness of between 30 to 100 $\mu$m.

* * * * *